United States Patent [19]

Kozima et al.

[11] 4,218,201

[45] Aug. 19, 1980

[54] APPARATUS FOR PRODUCING SOLIDIFIED GRANULAR SLAG FROM MOLTEN BLAST FURNACE SLAG

[75] Inventors: Yusuke Kozima, Sakaishi; Hideo Matsui, Kawachinaganoshi; Takao Chikakiyo, Sakaishi, all of Japan

[73] Assignee: Nippon Steel Corporation, Tokyo, Japan

[21] Appl. No.: 927,907

[22] Filed: Jul. 25, 1978

[51] Int. Cl.[2] ..... B22F 9/00

[52] U.S. Cl. ..... 425/7

[58] Field of Search ..... 425/7; 264/12

[56] References Cited

U.S. PATENT DOCUMENTS

| | | | |
|---|---|---|---|
| 1,355,984 | 10/1920 | Lewicki | 264/12 |
| 3,104,164 | 9/1963 | Osborne | 264/8 |

FOREIGN PATENT DOCUMENTS

| | | | |
|---|---|---|---|
| 282372 | 4/1971 | U.S.S.R. | 425/7 |

*Primary Examiner*—Donald J. Arnold
*Assistant Examiner*—James R. Hall
*Attorney, Agent, or Firm*—Wenderoth, Lind & Ponack

[57] ABSTRACT

A continuous stream of blast furnace molten slag flows down through a trough. The slag stream is dispersed by blowing a jet air stream against the back side of the stream in an upwardly inclined direction crossing the stream. The dispersed slag is carried by the air stream to granulate the slag. The amount of the jet air stream is not less than 500 $m^3$ per ton of the slag stream. The width of the jet air stream is greater than the width of the slag stream against which the air stream is blown. The speed of the jet air stream is 50–140 m/s at a nozzle outlet.

5 Claims, 18 Drawing Figures

APPARATUS FOR PRODUCING SOLIDIFIED GRANULAR SLAG FROM MOLTEN BLAST FURNACE SLAG

BACKGROUND OF THE INVENTION

1. Field of the Invention

The present invention relates to an apparatus for producing granular solidified slag from molten blast furnace slag. More particularly the present invention relates to an apparatus for producing solidified granular slag having a high density and uniform quality, useful as a fine aggregate and a road subbase.

2. Description of Prior Art

For the production of granular slag from molten blast furnace slag, which is produced in large amounts during in the blast furnace operation, by blowing a high-pressure gas, such as air and steam, to the molten blast furnace slag, it is conventionally known as shown in FIG. 1 to blow compressed air, inert gas, steam or high-pressure water to molten slag falling down from a trough 4 so as to finely divide the slag and cause the finely divided slag to be carried by the air and then fall into a cooling tank 6, where the slag is solidified, and the solidified slag is recovered by means of a conveyor 7.

However, this conventional system requires a large floor area for the equipment and large size equipment for recovering the granular slag. Further the granular high-temperature slag 1 is subjected to rapid cooling so that the quality of the product is thereby adversely influenced.

Thus, according to the conventional system, the molten blast furnace slag is blown off by high-pressure gas, and the blown slag is immediately subjected to rapid cooling by a rapid cooling agent, such as water, so that the molten slag is not always blown into a granular product. Rather, the production rate of fibrous slag wool is high, and even when a granular slag product is obtained, it is a swollen slag which is porous and has an angular surface, and thus inferior physical properties, particularly strength. Therefore, the product of the conventional system has been considerably limited in its application.

According to another conventional system as shown in FIG. 2, the molten blast furnace slag 1 is spouted into the air by means of a rotary drum 2 and is cooled in the air to obtain small granules of solidified slag, which are caused to fall onto a collection yard 3. In order to produce granular slag efficiently by this system, it is necessary to increase the diameter of the rotary drum 2 or increase the rotational speed thereof. However, this requires a larger area of the collection yard because the increased diameter or rotational speed expand the flying zone of the granular slag, so that the recovery efficiency is very low.

Also there is certain limitation in increasing the centrifugal force of the rotary drum 2 from a practical point of view. Therefore, according to this conventional system, the high-temperature slag is not completely solidified while it is flying through the air and it is very often that the slag granules fuse together even in the collection yard, so that efficient production of granular slag is not achieved.

SUMMARY OF THE INVENTION

Therefore, one object of the present invention is to solve the above disadvantages of the conventional systems and to provide an apparatus which can produce granular blast furnace slag (hereinafter called simply "granular slag") having uniform quality, high density, and excellent physical properties, particularly useful as structural aggregates and road subbase materials.

The above object of the present invention can be achieved by an apparatus including a device for forming a continuous stream of blast furnace molten slag flowing down through a trough, a device for dispersing the slag stream by blowing a jet air stream against the back side of the stream in an upwardly inclined direction crossing the stream, thereby carrying the dispersed slag together with the air stream to thus granulate the slag. The amount of the jet air stream is not more than 500 $m^3$ per ton of the slag stream. The width of the jet air stream is greater than the width of the slag stream by an amount not less than 50 m/m from both sides of the slag stream against which the air stream is blown, and the blowing speed of the jet air stream is 50–140 m/s at a nozzle outlet. Specifically, the apparatus includes a vessel for receiving molten blast furnace slag, a trough for receiving the molten blast furnace slag from a slag hole of the vessel, a flat nozzle positioned below the trough for blowing an air stream in a strip form against the molten slag flowing down from the end of the trough in an upwardly inclined direction from the lower side of the slag stream, and a device for supplying the air to the nozzle.

A collision plate is arranged in an angular direction across the path of the granulated semi-solidified slag dispersed in and carried by the air, so as to cause the slag to collide on the plate.

A cylindrical cell has a hole for discharging the solidified slag falling down below the collision plate.

An air-transfer duct connected to the discharge hole transfers the solidified slag together with the air stream to a storage tank by means of suction force of an induction fan. The storage tank has a receiving opening connected to the air-transfer duct and a device for discharging the solidified slag. The induction fan is connected to an exhaust duct of the storage tank.

Other objects and features of the present invention will be clear from the following description referring to the attached drawings showing embodiments of the present invention.

DETAILED DESCRIPTION OF THE INVENTION

The present invention will be described in detail referring to the embodiments shown in the attached drawings.

Figure 1:
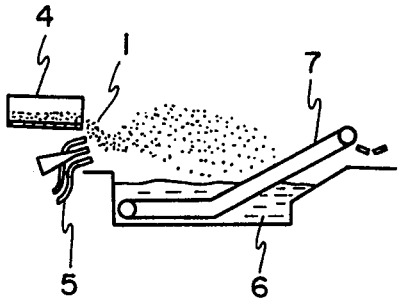
FIG. 1 PRIOR ART
FIG. 1 and FIG. 2 show schematically conventional methods.
Figure 2:
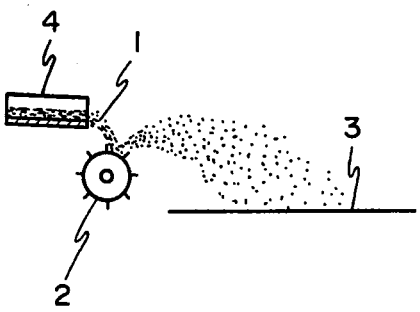
FIG. 2 PRIOR ART
Figure 3:
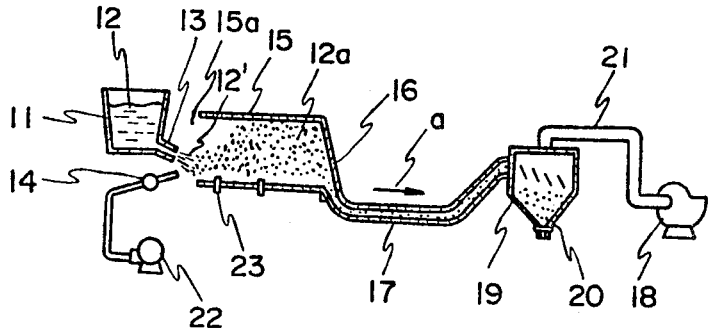
FIG. 3 is a schematic cross sectional view of the entire system of the apparatus according to the present invention.

In FIG. 3 showing one embodiment of the apparatus for producing the granular slag according to the present invention, 11 is a ladle for storing the molten slag 12, below which a trough 13 is provided. Below the trough 13, a blowing nozzle 14 is provided. The slag stream 12' flowing down from the trough 13 is divided and granulated in a tunnel 15 into semi-solidified granular slag **12*a* having a circular or almost circular cross section by the air blown from nozzle 14 across the slag stream in a direction inclined upwardly from the lower side. The granules of semi-solidified slag 12*a* are cooled while they are flying or entrained in the air within the tunnel 15 and become granular slag 12*b* and collide with a collision plate 16 provided at the rear portion of the tunnel 15, and are sucked into a transfer duct 17 together with the transfer gas mentioned hereinafter. In the tunnel 15 and the transfer duct 17, the blowing air, the air sucked from opening 15*a* of the tunnel 15, or the transfer gas forcedly supplied to the tunnel 15** is sucked in the direction marked by an arrow (*a*) by induction fan 18 as a slag carrying gas. The granular slag **12*b* sucked into the transfer duct 17 together with the transfer gas is further cooled by the transfer gas in the transfer duct 17 and introduced into a separator 19 such as a separator tank, where the slag granules are separated from the transfer gas, and the separated slag granules are recovered through a discharge gate 20 provided at the lower portion of the separator 19, while the separated transfer gas is exhausted through an induction pipe 21 by the induction fan 18**.

In the production of the granular slag **12*b*, the type and kind of the gas blown from the nozzle 14** and the blowing condition are important for obtaining a high quality of the slag granules.

Conventionally, steam has often been used for the blowing gas, because it is very easy to obtain high-pressure steam in large amounts, and it has been common to use a high pressure not lower than 5 kg/cm$^2$. However, such steam is expensive and presents problems in handling and safety. Further, when steam under a high pressure is used, the molten slag is hardly formed into granular slag and the production rate of slag wool becomes high, as mentioned hereinbefore, and thus steam is not desirable for the production of granular slag.

The present inventors have made various and extensive studies for utilizing air which is available at low cost and easy to handle, and have found that remarkable effects can be obtained by blowing air at a low velocity.

Thus, as the gas blown toward the slag stream 12' from the nozzle 14, air supplied from a blower 22 as shown in FIG. 3 is used, and the wind velocity at the nozzle 14 is controlled appropriately. Thereby a high quality of granular slag can be achieved.

Figure 4:
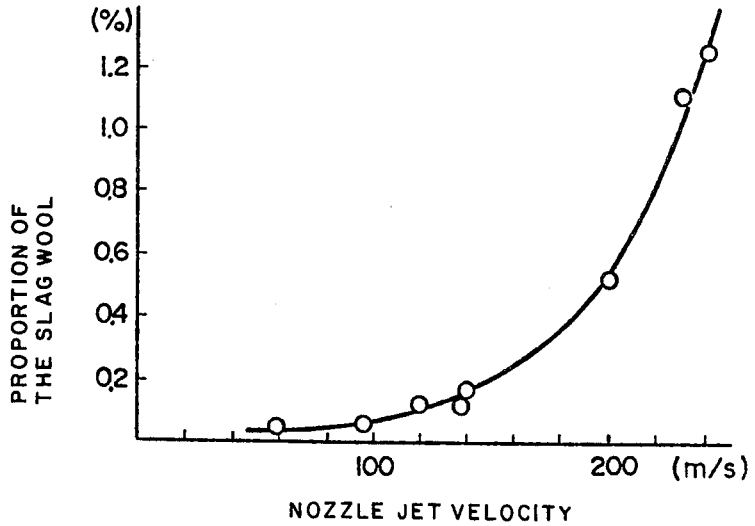
FIG. 4 is a graph showing production rate of the slag wool in correlation with changes in the air blowing speed at the nozzle.

FIG. 4 shows the results of producing the granular slag **12*b* by using the apparatus shown in FIG. 3, and particularly shows the production rate of slag wool in correlation with changes in the air velocity. As clearly understood from FIG. 4, as the air velocity, or nozzle jet velocity, is reduced, the production rate of slag wool is reduced. However, below a certain air velocity, the slag stream is not efficiently dispersed and is not satisfactorily granulated, but rather falls down as untreated slag on the lower portion of the tunnel 15, so that efficient production of granular slag is prevented. On the contrary, if the air velocity is increased, the problem of the non-treated slag is eliminated, but a large amount of slag wool is formed and a special means is required for removing the slag wool from the granular slag 12*b*, so that the resistance of the transfer gas to the suction increases and a larger capacity of induction fan 18** is not required.

A higher air velocity has less limitation in the production of granular slag **12*b*, but a very large capacity of the blower 22** is required for increasing the air velocity, and in an extreme case a compressor is required, so that it is difficult to maintain a required amount of air, and there are caused problems such that the noise of the air blowing is tremendous. There is no substantial difference in quality between the granular slag obtained by blowing the air at a high velocity and that obtained by blowing the air at a low velocity.

On the basis of the forgoing discoveries, the present inventors have made various studies for minimizing the formation of the slag wool, and have found that if the velocity of the air blown from the nozzle is within the range from 50 to 140 m/sec. The formation of the slag wool can be maintained at 0.2% or less so that no special means or device is required for removing the slag wool, and granular slag **12*b* of dense structure can be efficiently obtained without the occurrence of non-treated slag. In this case, it has also been found that if the amount of air as measured at the nozzle 14** is maintained at at least 500 m$^3$ per ton of the slag stream, increased energy is provided for the flying or entrainment of the granular slag and a desirable distribution of the granular slag can be obtained. Meanwhile, in order to carry almost all of the granular slag after granulation over a sufficient distance (at least 4 m or longer), it is necessary to maintain the width of the air stream greater than the width of the slag stream by at least 50 m/m or longer on both sides of the slag stream. In addition, it is necessary to maintain the amount of air at 500 $m^3/T$ or larger.

The limitations of the air velocity, the amount of air and the width of the air stream in the present invention are determined for the above reasons.

It is very natural that the temperature of the molten slag 12 flowing down from the trough 13 must be high enough for avoiding solidification of the molten slag in the ladle 11 and the trough 13.

However, when the temperature is too low, even if the solidification does not take place, the viscosity of the molten slag 12 increases and the particle size of the granular slag **12*b* obtained by blowing air at a low velocity is too large and a large amount of the molten slag remains untreated. On the other hand, when the temperature of the molten slag 12 is too high, the production rate of the slag wool increases. Thus, it is satisfactory if the temperature of the molten slag 12 flowing down from the trough 13 is about 1400° C., and if the temperature is low, it is necessary to control the temperature of the molten slag at 1300° C. or higher by heating the ladle 11 or the trough 13** with a conventional burner.

The semi-solidified granular slag **12*a* granulated by blowing air at low velocity from the nozzle 14 is cooled while flying or being carried through the tunnel 15 by the blown air and the air sucked in through the opening 15*a* of the tunnel 15**.

The tunnel 15 in the embodiment shown in FIG. 3 is an open type having an opening **15*a*. However, the tunnel 15 may be of a closed type into which the air or inert gas, etc., is supplied as the transfer gas and in which the semi-solidified granular slag 12*a*** is cooled and transferred by the transfer gas and the blown air while they are sucked by the induction fan.

The process in which the slag stream 12' is blown and the semi-solidified granulated slag **12*a* is cooled without fusing together again is very important for the quality of the granular slag 12*b***.

Thus, according to conventional methods, it is common that the semi-solidified granular slag, immediately after granulation and still at high temperatures, is allowed to fall into a water tank or is cooled by a rapid cooling agent, such as a water curtain. Therefore, the granular slag **12*b*** absorbs water during the cooling operation and becomes very often a swollen slag having a porous structure.

One of the features of the present invention is that the semi-solidified granular slag **12*a* immediately after granulation is caused to fly or be carried over a predetermined distance by the propelling force of the blown air and the sucking force of the transfer gas, and that the surface temperature of the semi-solidified granular slag 12*a*** is lowered during the such passage to a temperature not higher than the solidifying temperature.

In order to obtain better results by the present invention, it is necessary to control the dispersion direction of the molten slag stream flowing down the trough 13 and to extend the distance the granular slag is carried as far as possible.

Figure 5:
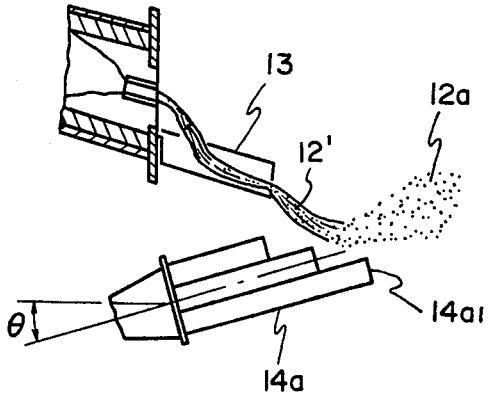
FIG. 5 is a cross sectional view of one embodiment of the blowing nozzle and its positional arrangement.

In FIG. 5 showing the arrangement of the nozzle, the nozzle **14*a* is designed to be a complex type in which the tip openings $14a_1$ are stepwisely displaced with respect to the slag stream 12'. A detailed description of this nozzle will be made with reference to FIG. 6 and FIG. 7**.

Figure 6:
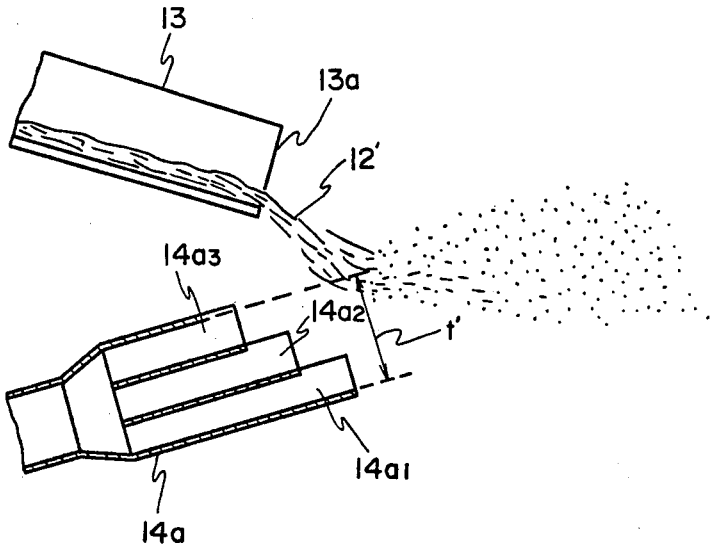
FIG. 6 is a cross sectional view of a preferable structure of the blowing nozzle.
Figure 7:
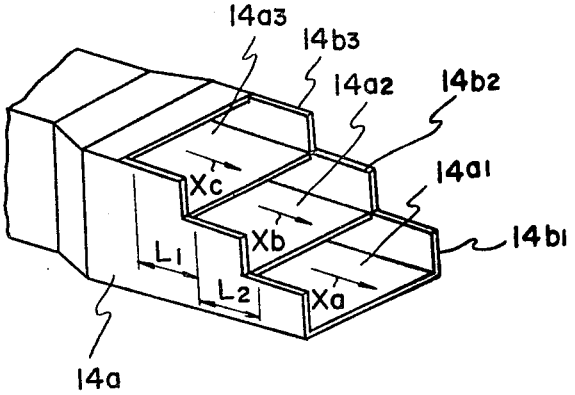
FIG. 7 is a perspective view of the blowing nozzle shown in FIG. 6.

The nozzle **14*a* in FIGS. 6 and 7 has a plurality of rectangular tip openings $14a_1$, $14a_2$ and $14a_3$ arranged successively one above the other, with the ends thereof being stepwisely displaced by the lengths L1 and L2**.

The air streams blown from the tip openings $14a_1$, $14a_2$, and $14a_3$ are parallel to each other as shown by the arrows Xa, Xb and Xc.

When the nozzle described above is arranged below the trough tip **13*a* as shown in FIG. 6 and the air jet is blown toward the slag stream 12', the pressure of the air jet colliding against the stream 12' can be equalized and the flying direction of the slag, i.e. the direction in which the slag is carried forward, is stabilized so that accurate and satisfactory granulation and dispersion of the slag can be effected, the degree of granulation is remarkably increased, and the flying time of the semi-solidified granular slag 12*a* is elongated. p In FIG. 7**, $14b_1$, $14b_2$ and $14b_3$ are guide plates for restricting the respective air jet streams.

With the width of the tip opening $14a_1$ of the complex nozzle **14*a* being wider than the slag stream 12' by at least 50 m/m beyond each side of the slag stream, and with the nozzle arranged with its center line extending at an upwardly declining angle ($\beta$) of from 10° to 45° to the horizontal, the flying distance is elongated, and the dispersion effect is remarkably enhanced. According to the present inventors' experiences, better results can be obtained with by a nozzle having a plurality of tip openings than with a nozzle having only one tip opening. The structure and size of the tunnel 15 may be determined depending on the flying range of the granular slag 12*a*** and the cooling capacity, etc.

As described above, the granular slag **12*a* dispersed within the tunnel 15 by the blown air is collected together with the transfer gas into the duct 17. In this connection, in order to collect efficiently the semi-solidified granular slag 12*a* dispersed in the tunnel 15, it is desirable that a collision plate 16 which is surface polished or water cooled is provided in the rear portion of the tunnel 15**.

As described hereinbefore, the slag stream 12' falling down from the trough is formed into granular slag **12*a* when blown with the air, and the semi-solidified granular slag 12*a* is carried into and through the tunnel 15 by the force of the blown air. The semi-solidified granular slag 12*a***, immediately after the commencement of its being carried is cooled while it is being carried and is gradually solidified from its surface.

Therefore, when the carrying distance is determined by free flying, the cooling of the semi-solidified granular slag **12*a*** proceeds to form a relatively thick surface shell around the granular slag, and the shape of the granular slag is hardly deteriorated. However, as mentioned hereinbefore, various problems, such as the requirement for vacant space for the treatment, are encountered.

The present inventors have made various studies on this point and have found that the above problems can be overcome by providing a collision plate 16 in the path of the carried semi-solidified granular slag **12*a***.

Figure 9:
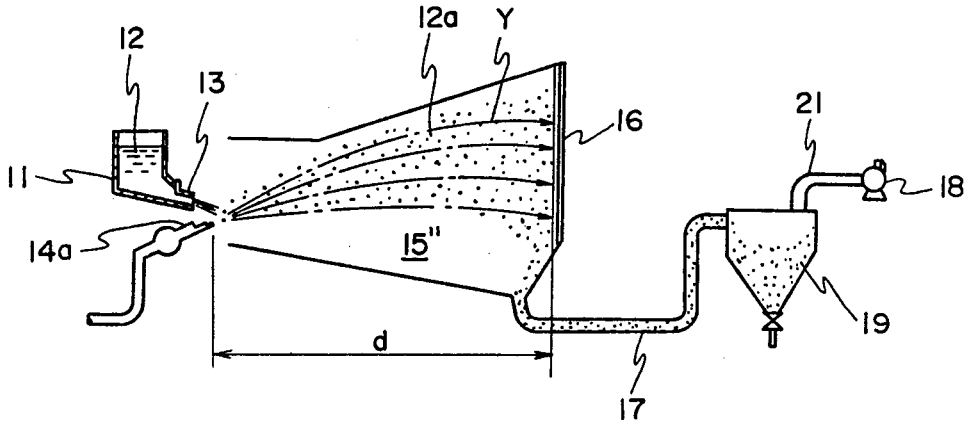
FIG. 9 is a cross sectional view of the apparatus according to the present invention showing particularly the arrangement of the collision plate in the tunnel.

Thus, the semi-solidified granular slag **12*a*, as shown by the dotted lines in FIG. 9, is carried along paths Y. In the present invention, the collision plate 16** is arranged at an appropriate position opposing the path Y.

Regarding the position of the collision plate 16, if the distance (d) from the nozzle **14*a* is too short, the temperature of the semi-solidified granular slag 12*a* is still high and the thickness of a solidified shell formed on the surface is very thin, so that when such a semi-solidified granular slag 12*a* collides with the collision plate 16**, the thin solidified shell is broken and the granular slag is flattened, thus resulting in a deteriorated shape quality.

Figure 10:
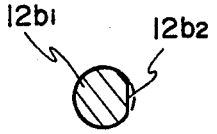
FIG. 10 is a cross sectional view of a desirable shape of the semi-solidified slag formed by collision against the collision plate.
Figure 11:
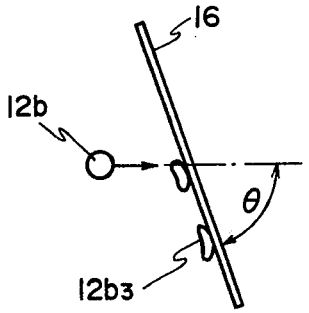
FIG. 11 is a schematic view showing the shape of the semi-solidified slag formed when the collision angle ($\theta$) with which the semi-solidified slag collides with the collision plate is out of the predetermined range.

According to the present inventors' experiences, when the collision plate 16 is positioned at such a distance (d) at which the temperature of the semi-solidified granular slag 12*a* is 1250° C. or lower, the formation of the solidified shell is promoted and the thickness thereof is also appropriately increased, so that the above adverse phenomena will very rarely take place, and although some granular slag $12b_1$ having flat portions $12b_2$ as shown in FIG. 10 will be made, granular slag 12*b* of good quality can be obtained. However, if the angle ($\theta$) at which the semi-solidified granular slag 12*a* collides with the collision plate 16 is outside a predetermined range, the semi-solidified granular slag 12*a* is formed into an elongated or flattened granules $12b_3$, even when the collision plate 16 is positioned at the distance (d) where the temperature of the semi-solidified granular slag 12*a* is 1250° C. or lower.

The present inventors have repeated various experiments and have found that as the collision angle ($\theta$) approaches 90° better granular slag 12*b* can be obtained, but if the angle falls outside the range of from 80° to 100°, the occurrence of the elongated granular slag 12*b* is sharply increased. When the granular slag 12*b* including flattened, elongated particles is used as filler in building materials, only lowered strength can be obtained, e.g. the flowability of cement mortars will be deteriorated. Therefore, in such a case the molten slag stream 12 can not have practical utility. The collision plate 16 may be arranged opposing the path Y in such a way that the temperature of the semi-solidified granular slag 12*a* is not higher than 1250° C. at the collision and that the semi-solidified granular slag 12*a* collides with the collision plate with a collision angle within the range of from 80° to 100°, in view of the blowing direction of the air which is determined by the arrangement of the nozzle and the air pressure, the path Y of the semi-solidified granular slag 12*a*, the amount and temperature of the molten slag stream 12 flowing down from the trough and the ambient temperature.

Figure 12:
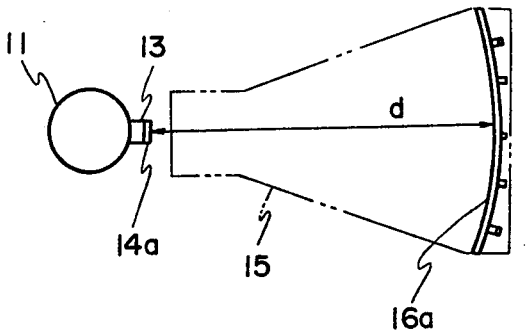
FIG. 12 is a schematic view of one embodiment of the arrangement of the collision plate.

In order to increase portions of the semi-solidified granular slag 12*a* which collide with the collision plate at a collision angle near 90°, a screen-like collision plate 16*a*, as shown in FIG. 12, having an arc-shaped cross section of with a radius equivalent to the above distance (d) from the tip of the nozzle 14*a*, or a screen-like collision plate including the similar arc portion is efficient.

On the other hand, when the positional distance (d) of the collision plate 16 is increased, the range of the collision angle ($\theta$) of the semi-solidified granular slag 12*a* can be expanded, and the deterioration of the slag shape hardly takes place. However, if the positional distance (d) is longer than the distance at which the temperature of the semi-solidified granular slag 12*a* is 1000° C. or lower, the flying range of the semi-solidified granular slag 12*a* is considerably expanded so that the collision plate 16 must have a very large size, thus causing problems in the supporting structure for the plate and in its manufacture, and lowering the recovery efficiency of the granular slag 12*b*.

For the above reasons, it is preferable that the collision plate 16 is positioned at a position at which the temperature of the semi-solidified granular slag 12*a* is in the range of from 1250° to 1000° C.

When the collision plate 16 is provided according to the present invention, the dispersed semi-solidified granular slag 12*a* collides with the plate 16 at an earlier stage and drops down and is sucked together with the transfer gas, so that it is possible to collect easily the semi-solidified granular slag 12*a* widely dispersed in the tunnel 15 into the duct 17 having a relatively small opening diameter and to transfer the granular slag quickly to the subsequent step, namely a separator 19. Therefore, the granular slag can be recovered efficiently, and the entire system can be made compact in size. Further, it is possible to produce the granular slag 12*b* even when the tunnel 15 is not completely closed and has many open parts.

Figure 8:
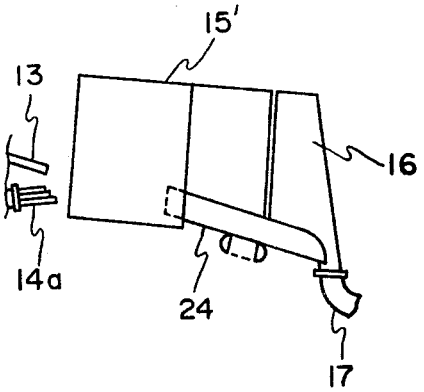
FIG. 8 is a side view of one embodiment of the tunnel according to the present invention.

In order to avoid as much as possible the difficulty that the semi-solidified granular slag 12*a* is not carried to the collision plate 16, but rather drops to the bottom of the tunnel 15 where the particles fuse together again and/or can not be recovered, it is preferable to forcedly supply air or inert gases, such as $N_2$ gas, as the transfer gas along the bottom and the side wall of the tunnel 15 as shown in FIG. 3, or to provide a vibration feeder 24 at the lower portion of the tunnel 15', as shown in FIG. 8, so as to transfer the dropping semi-solidified granular slag 12*a* to the inlet of the duct 17. In some cases, a hopper (not shown) may be efficiently provided at the lower portion of the tunnel 15' from which the granular slag is recovered.

In the present invention, it is preferable that the duct 17 is designed so as to prevent the fusing together of the semi-solidified granular slag 12*a* during the transfer operation and to perform the transfer operation efficiently.

Figure 13A:
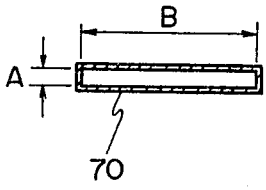
FIGS. 13(*a*) and 13(*b*) are, respectively, lateral and longitudinal cross sectional views of a preferable structure of the transfer duct according to the present invention.
Figure 13B:
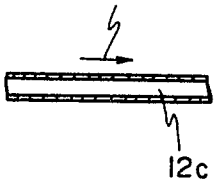

FIGS. 13(*a*) and 13(*b*) show the configuration of a preferable such duct 70. As shown, the duct has a rectangular cross section with a longer horizontal side B and a shorter vertical side A. The semi-solidified granular slag 12*a* is transferred through the duct 70, floating on or mixed with the transfer gas, and is cooled by contact with the transfer gas, solidifying into the solidified granular slag 12*b* before it reaches the separator tank 19. Therefore, in the first half portion of the duct 70, all of the slag remains as semi-solidified granular slag 12*a*, but as the slag advances into the last half portion the proportion of the solidified granular slag 12*b* increases. Hereinafter, the semi-solidified granular slag 12*a* and the solidified granular slag 12*b* including the semi-solidified granular slag which are transferred through the duct 70 are referred to as mixed granular slag 12*c*. It is very important for preventing contact between the particles of the mixed granular slag 12*c* and for enhancing the cooling effect that the mixed granular slag 12*c* in the transfer duct 70 is transferred in a state equally dispersed over the entire cross section of the duct 70.

Figure 14A:
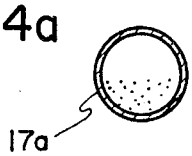
FIGS. 14(*a*), 14(*b*), 15(*a*), and 15(*b*) are views similar to FIGS. 13(*a*) and 13(*b*), but showing undesirable structures of the transfer duct.
Figure 14B:
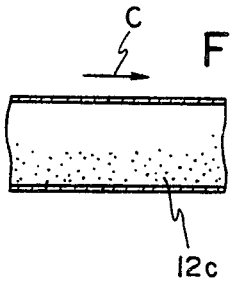
Figure 15A:
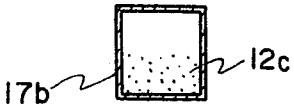
Figure 15B:
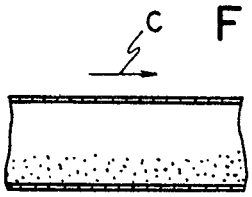
Figure 16A:
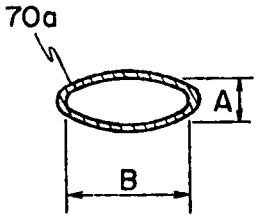
FIGS. 16(*a*) to 16(*d*) are cross sectional views of other embodiments of the transfer duct according to the present invention.
Figure 16B:
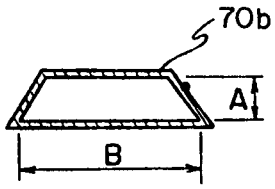
Figure 16C:
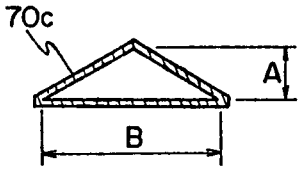
Figure 16D:
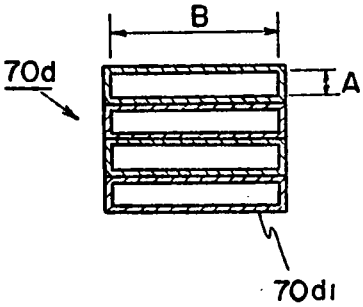

According to the present inventors' experiences, in the use of a conventional duct, such duct 17*a* having a circular cross section as shown in FIGS. 14(*a*) and 14(*b*) and duct 17*b* having a square cross section as shown in FIGS. 15(*a*) and 15(*b*), most of the mixed granular slag 12*c* is dispersed in the lower half portion of the duct 17*a* or 17*b*, and as shown in FIG. 14(*b*) and in FIG. 15(*b*). There is a remarkable difference in density between the upper portion and the lower portion of the mixed granular slag, because the mixed granular slag is transferred separately from the major portion of the transfer gas, and in the lower portion having a larger density, particles of the mixed granular slag 12*c* vigorously contact and collide with each other so that the cooling effect is remarkably hindered and the resultant granular slag fuses together considerably. The above phenomenon is particularly vigorous in cases where the mixed granular slag 12c is subjected to centrifugal force, as in curved portions of the ducts 17a or 17b, and the fusing together of the particles of the mixed granular slag 12c is very often seen in such curved portions. The present inventors have made various studies of the relation between the cross sectional shape of the transfer duct and the transfer of the mixed granular slag 12c, and have solved the problem as mentioned above by using the transfer duct 70 having an elongated cross section with a shorter vertical side A and a longer horizontal side B as shown in FIG. 13(*a*). As there is a large difference in the specific gravity between the transfer gas and the mixed granular slag 12c, the mixed granular slag 12c tends to sink down in the lower portion of the transfer duct 17a or 17b having a circular or square cross section, and in order to prevent such sink-down phenomenon, it is necessary to increase the suction of the transfer gas and to increase the velocity of the transfer gas in the duct 17a or 17b. However, any increase of the suction of the transfer gas requires an increased capacity of the suction blower 18 and a huge capital expense.

In the present invention, the ratio of the vertical side A to the horizontal side B, namely A/B is maintained at a small value so that the mixed granular slag 12c can be dispersed uniformly over the entire area of the duct 70, even with a small amount of the transfer gas, thus increasing the effective cross sectional dimension for transferring the mixed granular slag in the duct 70. A smaller value of A/B can produce a better result. It has been found through experiences of the present inventors that when the ratio of A/B is not larger than 0.5 the mixed granular slag 12c is dispersed over the entire area of the duct 70 as shown in FIG. 13(*a*) and FIG. 13(*b*) so that the desired results of the present invention can be fully obtained, and it has also been found that it is advantageous to maintain the ratio of A/B to 1.0 or less when a larger amount of slag is treated. However, when the ratio of A/B is 0.02 or less, the resistance to the transfer in the duct 70 is remarkably increased and the load on the suction blower is sharply increased, and the length of the horizontal side B is too long for a practical operation. Therefore, in the present invention, the ratio of A/B is limited to the range from 0.5 to 0.02. In the drawing, the duct 70 is shown to have a rectangular cross section for easier manufacturing but it should not be limited to the rectangular cross section and it may have any cross sectional shape as long as the ratio of A/B falls within the range of from 0.5 to 0.02. For example, a duct 70a having an elliptic cross section as shown in FIG. 16(*a*), a duct 70b having a trapezoidal cross section as shown in FIG. 16(*b*), or a duct 70c having a triangular cross section as shown in FIG. 16(*c*) may be used. In cases where the amount of slag to be treated is large and the ratio of A/B must be made small, so that some operational problems are most likely to occur due to a too greatly elongated width of the duct 70, it is advantageous that the duct 70d is formed by a plurality of ducts $70d_1$ each having a ratio of A/B within the range of from 0.5 to 0.02 and mounted in a multiple layers as shown in FIG. 16(*d*).

Figure 17:
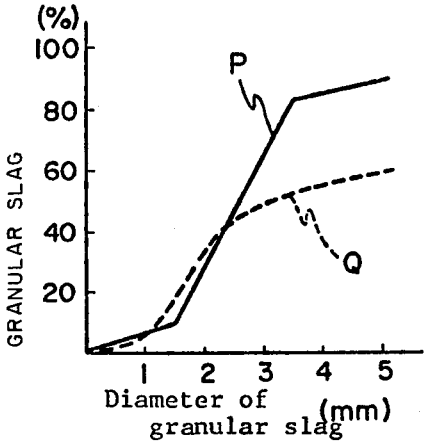
FIG. 17 is a graph illustrating the effects of the lateral cross section of the transfer duct on the granular slag, in which the solid line P shows the results obtained by using a transfer duct having a rectangular cross section as shown in FIGS. 13(*a*) and 13(*b*) with the ratio of the width to the length being 0.1, and the broken line Q shows the results obtained by using a transfer duct having a circular cross section as shown in FIGS. 14(*a*) and 14(*b*).

FIG. 17 shows results, particularly the particle size of the granular slag 12b and its proportion obtained by embodiments of the present invention in which the solidified granular slag 12b is produced from a molten blast furnace slag using the granular slag production apparatus as shown in FIG. 3 with various cross sections of the duct 17. In FIG. 17, the solid line P represents the results obtained by experiments using the duct 70 having a rectangular cross section with the ratio of A/B being 0.1, and the broken line Q represents results of experiments using the duct 17a having a circular cross section as shown in FIG. 14a. In the experiments the ducts 70 and 17a had the same cross sectional area, and the same velocity of the transfer gas was used. The amount of the molten blast furnace slag treated in these experiments were about 15 tons per hour, the velocity of the transfer gas was 40 m per second and the length of the ducts 70 and 17a was 20 m.

Meanwhile, it has been found from other experiments that most of the granular slag 12b produced by the production apparatus mentioned above is susceptible to fusing together after granulation when the particle size is 5 mm or larger, and the shape and quality of the granular slag 12b are severely degraded. As will be understood from FIG. 17, in the case of the duct 17a of a circular cross section, the granular slag 12b having a diameter not smaller than 5 mm reaches 40% or higher and the granules having a particle size of 5 mm or larger fuse together into larger granules, maintaining almost no initial shape of the granular slag 12b. However, in the case of the duct 70 according to the present invention, the granular slag 12b having a diameter of 5 mm or larger is only 12%, and most of the granules having a diameter of 5 mm or larger retain the initial shape. Thus, the excellent effects of the duct according to the present invention has been confirmed.

As described above, when the transfer duct 70 having a broad width is used, it is possible to efficiently utilize the transfer gas sucked into the duct, and even when the velocity of the transfer gas is small, the mixed granular slag 12c is dispersed widely and uniformly in the duct 70. Thus, the density of the mixed granular slag 12c being transferred is relatively low and uniform throughout the duct so that there is no danger of fusing together of the mixed granular slag in the duct 70, and the mixed granular slag is cooled efficiently.

As compared with the conventional duct 17a or 17b, the transfer duct 70 having the same cross sectional area according to the present invention has technical advantage in that the amount of the air to be sucked can be reduced, that the length of the duct can be reduced, that the danger of fusing together of the granular slag 12b recovered in the separator tank is remarkably lessened, that fine granular slag 12b of good quality can easily be obtained, and that the mixed granular slag is transferred in a completely entrained condition in the duct 70 so that the mixed granular slag does not adhere to the inside wall of the duct 70. Thus, quite efficient transfer of the mixed granular slag can be performed and the granular slag 12b can be efficiently recovered at a predetermined position.

The transfer gas used in the present invention is often used as a generic term to include the air blown from the nozzle, the air sucked from the opening 15a and other openings of the tunnel 15, and the transfer gas supplied into the tunnel 15 or along the bottom surface and side surface of the tunnel 15.

In the embodiment shown in FIG. 3, the air of ordinary temperature is blown through the nozzle, and only this blown air of ordinary temperature and air of ordinary temperature sucked through the opening 15a and other openings of the tunnel are used as the transfer gas. In this case, however, the surface temperature of the granular slag 12a, when it collides with the end portion, namely the collision plate 16 and drops down, is lowered to about 1100° C., and at this point the granular slag 12a is almost complete.

In this embodiment, the length of the tunnel is 13 m, the length of the duct 17 is 10 m and the temperature of the granular slag 12a at the time of discharge from the separator 19 is about 750° to 800° C.

Figure 18:
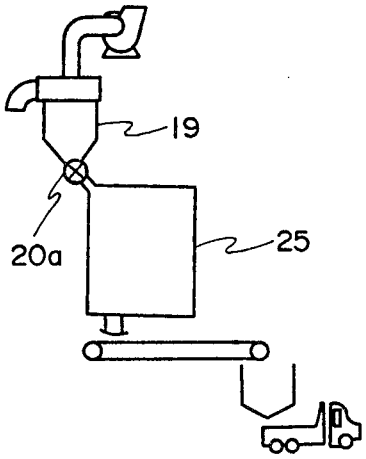
FIG. 18 is a schematic view of one embodiment of the recovering device for recovering the granular slag.

The feasibility of handling the granular slag 12b discharged from the separator 19 is very good, and the granular slag 12b is taken out through a heat exchanger 25 (FIG. 18) connected to the discharge gate 20a of the separator 19 so that industrial recovery of heat can be achieved, thus assuring a great industrial utility.

When the surface temperature of the granular slag 12a at the end portion of the tunnel 15 is about 1100° C. or lower, water is sprayed on the granular slag in the transfer duct 17, so as to increase the cooling effect. Even in this case, there is no influence on the quality of the granular slag 12b, and the length of the duct 17 can be shortened. Thus, such water spraying is effective, particularly when a large amount of slag is treated.

Tables 1 to 3 show physical properties of the granular slag 12b produced according to the present invention. In Table 1 one example of the particle size distribution of the granular slag 12b according to the present invention is compared with the particle size distribution of natural sand (sea sand of Muroki Iland of Kagawa-ken, Japan) and the standard particle size specified by Japan Civil Engineering Association. The granular slag 12b alone is outside the rougher side of the standard of the association. However, it is understood that the particle size distribution in accordance with the standard can be almost achieved when the granular slag is mixed with fine natural sand or conventionally known water-broken slag in a mixing ratio of 1:1. Also it has been revealed that granular slag which falls down on the lower portion of the wind tunnel 15 and slightly fused together can satisfy the above standard of particle size distribution when it is slightly crushed.

Table 1

| Nominal Size of Sieve mm | Total Amount passing the Sieve (%) Granular Slag | Sea Sand | Synthetic Sand = 1(Granular Slag) : 1 (Sea Sand) | Standard of Particle Size by C.E.A. |
|---|---|---|---|---|
| 10 | 100 | 100 | 100 | 100 |
| 5 | 99.4 | 99.9 | 99.7 | 90–100 |
| 2.5 | 62.6 | 96.9 | 79.8 | 80–100 |
| 1.2 | 18.7 | 83.6 | 51.2 | 50–90 |
| 0.6 | 2.1 | 53.6 | 27.9 | 25–65 |
| 0.3 | 0.4 | 16.4 | 8.4 | 10–35 |
| 0.15 | 0.2 | 0.5 | 0.4 | 2–10 |

Table 2

| | Granular Slag | Sea Sand | Standard Value Basic Standard Value | Water Granulated Slag | Hard Water Granulated Slag |
|---|---|---|---|---|---|
| Unit Weight g/cm$^3$ JIS A1104 | 1.76 | 1.51 | 1.5–1.85 (None) | 0.8–1.0 | 1.35 |
| Specific Gravity (Dry Surface) g/cm$^3$ JIS A1109 | 2.83 | 2.54 | 2.50–2.80 (Not less than 2.5) | 2.1–2.3 | 2.56 |
| Water Absorption Rate (%) JIS A1109 | 1.2 | 2.01 | 1–2 (Not more than 3) | — | 2.3 |
| Amount which floats on Liquid having a Specific Gravity of 1.95 (%) | 0 | 0.5 | Not more than 0.5 (Not more than 0.5) | — | — |
| Amount of Material Finer than Standard Sieve 0.88 (%) JIS A1103 | 0.2 | 0.1 | 3–5 (Not more than 3) | — | 6.04 |
| Stability (%) JIS A1122 | 1.11 | — | Not more than 10 (Not more than 10) | — | 10.88 |
| Coarse Particle (FM-Value) JIS A1102 | 4.17 | 2.49 | 2.3–3.1 (2.3–3.1) | 3.0–3.3 | 3.34 |

Table 3

| Aggregates | Components of Mortar: Water (g) | Cement (g) | Ratio of Water to Cement (%) | Sea Sand (g) | Granular Slag (g) | Flowability (cm) | Strength after one Week $\sigma_7$ (Kg/cm$^2$) | Density of Solid Mortar (g/cm$^3$) |
|---|---|---|---|---|---|---|---|---|
| Sea Sand | 275 | 550 | 50 | 1138 | 0 | 18.8 | 263 | 2.15 |
| Granular Slag + Sea Sand | 275 | 550 | 50 | 806 | 806 | 18.9 | 262 | 2.32 |
| Granular Slag | 275 | 550 | 50 | 0 | 1991 | 19.1 | 190 | 2.42 |

Table 2 shows physical properties of the granular slag 12a, sea sand, water granulated slag and hardwater granulated slag, and standard values (basic standard values) of the physical properties.

Table 3 shows results of mortar tests conducted for determining how much aggregate, namely the granular slag 12b and sea sand, can be used with a constant ratio of water to cement. In these tests flowability was used as the control value for measuring workability. When the granular slag 12b according to the present invention is used, the flowability increases so that it is possible to increase the amount of aggregate, namely the granular slag 12b, per unit amount of cement, thus reducing cement consumption.

As described above, according to the present invention, it is possible to efficiently produce granular slag having a dense structure and a smooth surface in the form of spherical or nearly spherical granules having a uniform particle size, and the granular slag produced according to the present invention has very excellent physical properties, is very useful as aggregates in cement constructions and as material of a road subbase. Thus, the present invention has expanded the application of blast furnace slag and has a very significant industrial advantage.

What is claimed is:

1. An apparatus for producing solidified granular slag from molten blast furnace slag, said apparatus comprising:

a vessel adapted to be positioned to receive molten slag from a blast furnace, said vessel having a slag hole for discharging therefrom said molten slag;

trough means, positioned to receive molten slag from said slag hole, for forming a discharged molten slag stream;

nozzle means, positioned below said slag stream, for directing a flat strip-shaped stream of air in an upwardly inclined direction against said slag stream, for thereby forming said slag stream into semi-solidified granular slag, and for entraining and carrying said semi-solidified granular slag along a path extending in a substantially horizontal direction;

collision plate means, positioned in said path of said semi-solidified granular slag, for causing said semi-solidified granular slag to collide with said collision plate means and drop downwardly;

an air transfer duct having a first end positioned to receive said semi-solidified granular slag which drops downwardly from said collision plate means and a second end;

a separator tank connected to said second end of said air transfer duct; and suction means, connected to said separator tank, for creating a vacuum in said separator tank and in said air transfer duct, and for thereby drawing air and said semi-solidified granular slag through said transfer duct, wherein said semi-solidified granular slag solidifies to form solidified granular slag, and into said separator tank, wherein said solidified granular slag is collected.

2. An apparatus as claimed in claim 1, further comprising a tunnel surrounding said semi-solidified granular slag during movement thereof through said path, said tunnel having a substantially open end positioned adjacent said trough means and said nozzle means, and an opposite end partly closed by said collision plate means.

3. An apparatus as claimed in claim 1, wherein said collision plate means extends in a substantially perpendicular direction to said path of said semi-solidified granular slag.

4. An apparatus as claimed in claim 1, wherein said nozzle means comprises a nozzle having plural nozzle openings arranged stepwise in the direction of air blown therefrom, each said nozzle opening having a rectangular cross section with a larger width than height.

5. An apparatus as claimed in claim 1, wherein said air transfer duct extends substantially horizontally and has a rectangular transverse cross section, with the ratio of the height thereof to the width thereof being from 0.02 to 0.5.

* * * * *